US006932169B2

(12) United States Patent
Wylie et al.

(10) Patent No.: US 6,932,169 B2
(45) Date of Patent: Aug. 23, 2005

(54) SYSTEM AND METHOD FOR DEVELOPING AND RECYCLING DRILLING FLUIDS

(75) Inventors: Glenda Wylie, Spring, TX (US); Frank Zamora, Duncan, OK (US); Donald L. Whitfill, Kingwood, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 268 days.

(21) Appl. No.: 10/201,419

(22) Filed: Jul. 23, 2002

(65) Prior Publication Data

US 2004/0016572 A1 Jan. 29, 2004

(51) Int. Cl.[7] ..... E21B 21/06
(52) U.S. Cl. ..... 175/66; 175/206; 175/207
(58) Field of Search ..... 175/66, 206, 207, 175/40; 166/265, 267

(56) References Cited

U.S. PATENT DOCUMENTS

| | | | | |
|---|---|---|---|---|
| 3,301,323 A | * | 1/1967 | Parsons | 175/66 |
| 3,433,312 A | | 3/1969 | Burdyn et al. | 175/66 |
| 3,591,147 A | | 7/1971 | Anderson et al. | 259/154 |
| 3,713,499 A | * | 1/1973 | Arscott et al. | 175/66 |
| 4,297,225 A | | 10/1981 | Hartley | 210/779 |
| 4,444,277 A | | 4/1984 | Lewis | 175/66 |
| 4,599,117 A | | 7/1986 | Luxemburg | 134/25.1 |
| 4,636,308 A | | 1/1987 | Summers | 210/195.1 |
| 4,765,415 A | * | 8/1988 | Khalafalla et al. | 175/50 |
| 4,779,186 A | | 10/1988 | Handke et al. | 364/172 |
| 5,046,855 A | | 9/1991 | Allen et al. | 366/137 |
| 5,114,239 A | | 5/1992 | Allen | 366/6 |
| 5,190,374 A | | 3/1993 | Harms et al. | 366/165 |
| 5,195,824 A | | 3/1993 | Stromberg et al. | 366/131 |
| 5,258,123 A | | 11/1993 | Huang et al. | 210/663 |
| 5,382,411 A | | 1/1995 | Allen | 422/131 |
| 5,426,137 A | | 6/1995 | Allen | 523/318 |
| 5,522,459 A | | 6/1996 | Padgett et al. | 166/285 |
| 5,538,341 A | | 7/1996 | Padgett et al. | 366/134 |
| 5,814,230 A | | 9/1998 | Willis et al. | 210/710 |
| 5,944,195 A | * | 8/1999 | Huang et al. | 209/39 |
| 5,961,438 A | | 10/1999 | Ballantine et al. | 588/250 |
| 6,073,709 A | | 6/2000 | Hensley | 175/207 |
| 6,106,733 A | * | 8/2000 | Wood | 210/774 |
| 6,315,894 B1 | | 11/2001 | Wiemers et al. | 210/96.1 |
| 6,413,297 B1 | | 7/2002 | Morgan et al. | 95/22 |

FOREIGN PATENT DOCUMENTS

| | | | |
|---|---|---|---|
| EP | 0 426 231 A2 | 5/1991 | G01N/15/06 |
| FR | 1.259.352 | 11/1954 | |
| WO | WO 02/36929 A1 | 5/2002 | E21B/21/06 |

* cited by examiner

*Primary Examiner*—David Bagnell
*Assistant Examiner*—K. Thompson
(74) *Attorney, Agent, or Firm*—Craig W. Roddy; Haynes & Boone, LLP

(57) ABSTRACT

A system and method for developing and recycling drilling fluids at the site of a subterranean well is described, thus eliminating the need for transporting the fluids to the site.

16 Claims, 2 Drawing Sheets

SYSTEM AND METHOD FOR DEVELOPING AND RECYCLING DRILLING FLUIDS

BACKGROUND

This invention relates to a system and method of developing a drilling fluid in an efficient and environmentally-friendly manner. This invention further relates to recycling a drilling fluid.

Drilling fluids are used downhole in well-drilling operations in treating subterranean wells. In offshore drilling operations, these drilling fluids are usually mixed onshore in large full scale production volumes and are delivered to the offshore platform by trucks and barges and stored for later use. However, this can be time-consuming, and the equipment needed to transport and store the drilling fluids is costly. Therefore what is needed is a system and method of developing drilling fluids which eliminates these problems.

DETAILED DESCRIPTION

Figure 1:
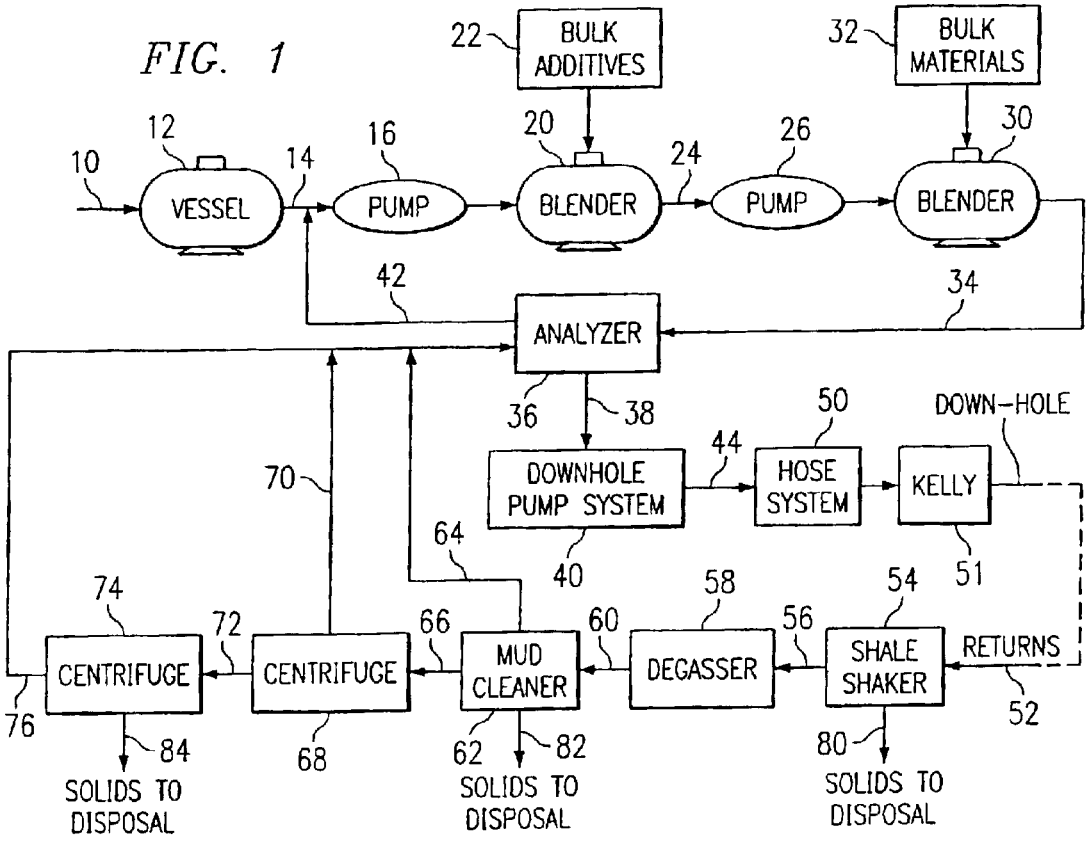
FIG. 1 is a schematic view depicting an embodiment of the invention.

An embodiment of the system and method of the present invention will be described in connection with the drilling of a subterranean well in an offshore location with a water-based fluid in FIG. 1.

Water, such as seawater, is recovered in any conventional manner and passes, via a conduit 10, to a vessel 12 in which chemicals are added to the water to discourage bacteria growth. The treated water then passes through a conduit 14 under the action of a pump 16 and into a blender 20.

Specialty drilling additives from a container 22 are added to the water in the blender 20 to mix with the water to develop an initial water-based drilling fluid (hereinafter referred to as "drilling fluid"). The specialty drilling additives may include fluid controlling additives such as starches, encapsulating polymers, or other dry material such as caustic soda, sodium chloride, and silicic acid, and/or concentrated liqueurs.

The drilling fluid then passes from the blender 20 through a conduit 24 under the action of a high shear pump 26, which pumps the drilling fluid into a blender 30 and maximizes the efficiency of materials introduction. Various bulk materials, such as bentonite and barite, from a container 32, mix with the drilling fluid in the blender 30 to further develop the drilling fluid. It will be understood that drilling additives and materials are drilling fluid components.

The drilling fluid then passes from the blender 30 through a conduit 34 into an analyzer 36 which includes one or more of a number of specialty instruments such as a volume meter, a three-phase meter, a PH meter, and a mud analyzer for measuring rheology and other fluid properties. The analyzer 36, including the above instruments, analyzes the drilling fluid and provides information as to the suitability of the drilling fluid for use downhole.

If the analyzer 36 determines that the drilling fluid is suitable for use downhole, the drilling fluid from the analyzer is directed into a conduit 38 for passage to a downhole pump system 40. If the analyzer 36 determines that the drilling fluid is unsuitable for use downhole, the drilling fluid is directed into a conduit 42 which is connected to the conduit 14 for recycling and therefore reconditioning the unsuitable drilling fluid.

After entering and passing through the downhole pump system 40, the drilling fluid passes through a conduit 44 to and through a hose system 50 and a kelly 51 to a downhole location for assisting in the further drilling of the well.

After use, the drilling fluid is returned from the downhole location, via a conduit 52, to a shale shaker 54 with vibrating screens to separate out larger drill cuttings (solids) for disposal. The drilling fluid then passes through a conduit 56 and into a degasser 58 to remove unwanted gas from the drilling fluid. For further cleaning, the drilling fluid then passes through a conduit 60 to a mud cleaner 62 that includes hydrocyclones positioned over small mesh screens to remove smaller drill cuttings for disposal.

From the mud cleaner 62, the majority of the drilling fluid is recycled through a conduit 64. A smaller amount of drilling fluid passes through a conduit 66 to a centrifuge 68 wherein barite is separated out and recycled through a conduit 70. The drilling fluid from the centrifuge 68 passes through a conduit 72 to another centrifuge 74 that separates out the smallest drill cuttings for disposal. The drilling fluid from the centrifuge 74 is then recycled through a conduit 76. During the passage of the drilling fluid through the conduit 76, the recycled barite from the conduit 70 and the drilling fluid from the conduit 64 are added and mixed with the drilling fluid in the conduit 76 to prepare the drilling fluid for entry into the analyzer 36. The analyzer 36 again determines the suitability of the drilling fluid for reuse downhole. Alternatively, the recycled water-based drilling fluid may be passed, via the conduit 76, to the sea or ocean in a safe manner adhering to environmental regulations or used to develop a new drilling fluid system for a new hole section.

The separated drill cuttings from the shale shaker 54, the mud cleaner 62, and the second centrifuge 74 are extracted via conduits 80, 82, and 84, respectively, and sent back to shore for an environmentally safe disposal or disposed of on location if regulations allow.

ALTERNATES AND EQUIVALENTS

Figure 2:
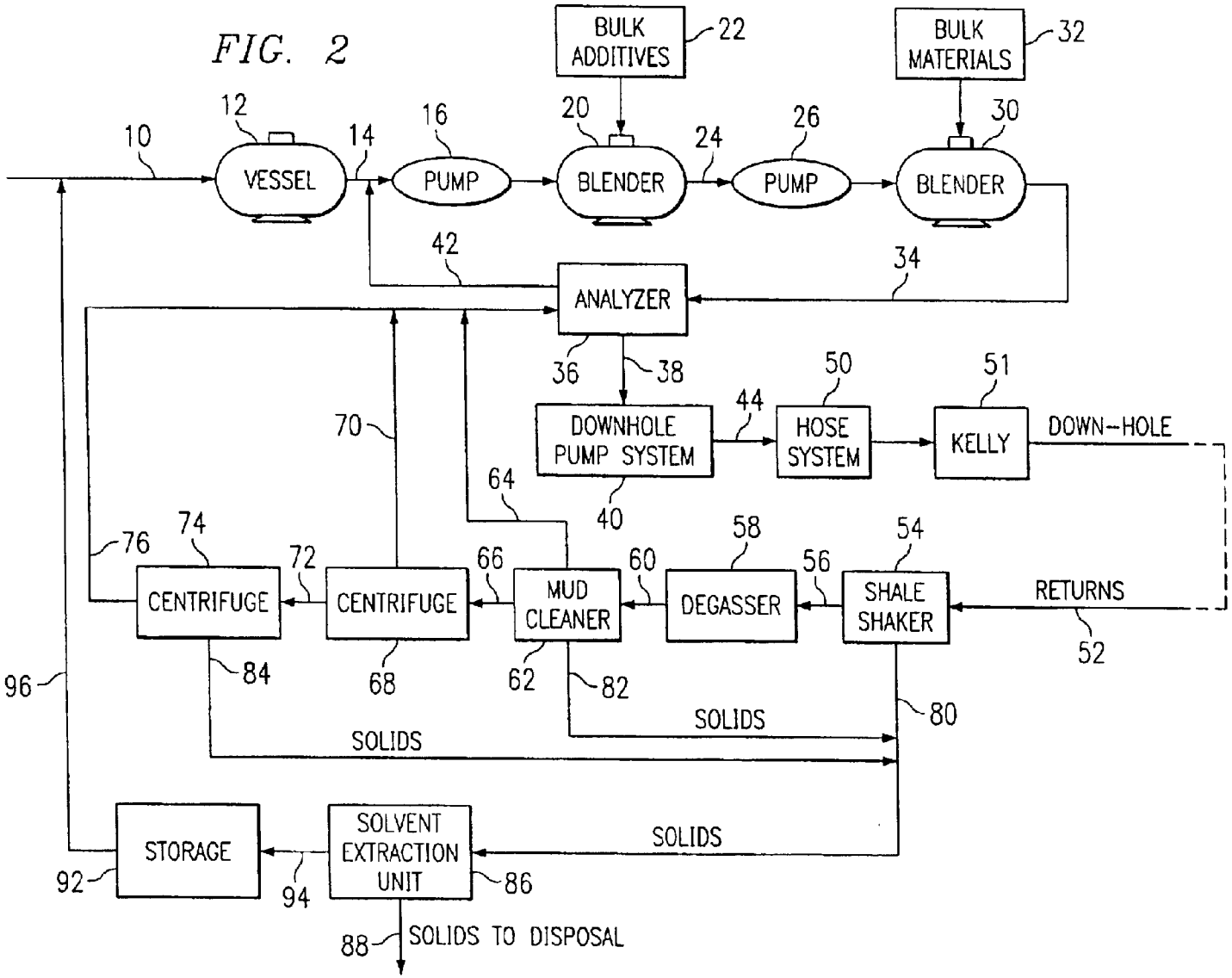
FIG. 2 is a schematic view depicting an alternative embodiment of the invention.

FIG. 2 depicts an alternative embodiment of the system and method of the present invention that will be described in connection with the drilling of a subterranean well in an offshore location with a hydrocarbon-based fluid. The embodiment of FIG. 2 is similar to that of FIG. 1, and includes substantially similar components which are given the same reference numerals.

A hydrocarbon-base fluid is delivered in any conventional manner to the conduit 10 for introduction into the vessel 12. The hydrocarbon-base fluid is developed into a hydrocarbon-based drilling fluid (hereinafter referred to as "drilling fluid") for use downhole in substantially the same manner as the water-based fluid in the previous embodiment. Thus, it passes through the system in the manner described above before it passes through the hose system 50 and the kelly 51 to a downhole location. The drilling fluid returns from the downhole location in a conventional manner and is passed through the shale shaker 54, the mud cleaner 62 and the additional centrifuge 74 in the manner described above in connection with the embodiment of FIG. 1. Drill cuttings (solids) are removed from the shaker 54, the mud cleaner 62 and the additional centrifuge 74 via conduits 80, 82, and 84, respectively and pass into a solvent extraction unit 86 to recover the hydrocarbon-base fluid.

The solvent extraction unit 86 contains a lower pressure liquid recovery section, wherein the hydrocarbon-base fluid is recovered from the hydrocarbon-based drilling fluid still on the drill cuttings. In particular, the solvent extraction unit 86 contains lower boiling point hydrocarbon-based solvent fluids, or alternatively carbon dioxide, to extract the higher boiling point hydrocarbon-base fluid from the drill cuttings. The drill cuttings may then be disposed of in a safe manner adhering to environmental regulations through conduit 88.

After recovery of the hydrocarbon-base fluid, the solvent fluids undergo a recompression cycle so that they may be recycled for later use. The hydrocarbon-base fluid is then recycled to a storage container 92 via a conduit 94. The storage container 92 stores the hydrocarbon-base fluid for reuse and is connected to the conduit 10 via a conduit 96 for recycling the hydrocarbon-base fluid back to the vessel 12 for reintroduction into the drilling fluid system.

The benefits of this system are twofold. First, well construction costs can be reduced by minimizing the volume of drilling fluids used, maximizing the recycling of well-drilling fluids and cuttings, and reducing transportation costs associated with drilling fluids. Secondly, the drilling fluids and components of this system are environmentally friendly in that they are dramatically reduced in volume and can be reused for other well-drilling operations.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to cover the structures described herein as performing the recited function. In the claims, means-plus-function clauses are intended to cover the structures described herein as performing the recited function and not only structural equivalents, but also equivalent structures.

What is claimed is:

1. A method for developing and recycling drilling fluid, comprising:

establishing a flow path for a base fluid;

blending the base fluid with drilling fluid components in the flow path to form a drilling fluid;

analyzing the drilling fluid to determine if it is suitable for passage downhole;

passing the suitable drilling fluid downhole;

recycling the non-suitable drilling fluid back to the flow path;

returning the suitable drilling fluid from downhole;

separating solids from the returned fluid; and recovering any hydrocarbon-base fluids from the separated solids.

2. The method of claim 1 wherein the non-suitable drilling fluid mixes with the fluid in the flow path before the step of blending so that the components are blended with the base fluid and the non-suitable drilling fluid.

3. The method of claim 2 wherein the step of analyzing is after the non-suitable fluids are mixed with the base fluid and after the step of blending.

4. The method of claim 1 further comprising passing the returned fluid to the flow path where it is subjected to the steps of analyzing, passing, and recycling.

5. The method of claim 1 wherein the step of separating comprises passing the returned fluid through a shale shaker, a degasser, and a mud cleaner.

6. The method of claim 1 further comprising passing the separated fluid to the flow path where it is subjected to the steps of analyzing, passing, and recycling.

7. The method of claim 1 wherein the fluid is seawater and further comprising passing the returned fluid to the sea.

8. A method for developing and recycling drilling fluid, comprising:

establishing a flow oath for a base fluid, blending the base fluid with drilling fluid components in the flow path to form a drilling fluid, analyzing the drilling fluid to determine if it is suitable for passage downhole, passing the suitable drilling fluid downhole, recycling the non-suitable drilling fluid back to the flow path, returning the suitable drilling fluid from downhole, separating solids from the returned fluid, passing the separated fluid to the flow path where it subjected to the steps of analyzing, passing, and recycling, and recovering any hydrocarbon-base fluids from the separated solids.

9. A method for developing and recycling drilling fluid, comprising:

establishing a flow path for a base fluid;

adding drilling fluid components to the base fluid in the flow path to form a drilling fluid;

analyzing the drilling fluid to determine if it is suitable for passage downhole;

passing the suitable drilling fluid downhole;

mixing the non-suitable drilling fluid with the fluid in the flow path before the components are added;

returning the suitable drilling fluid from downhole;

separating solids from the returned fluid;

passing the separated fluid to the flow path; and recovering any hydrocarbon-base fluids from the separated solids.

10. The method of claim 9 wherein the separated fluid mixes with the fluid in the flow path and is subjected to the steps of analyzing and passing.

11. The method of claim 9 wherein the step of separating comprises passing the returned fluid through a shale shaker, a degasser, and a mud cleaner.

12. The method of claim 9 wherein the fluid is seawater and further comprising passing the separated fluid to the sea.

13. A method for developing and recycling drilling fluid, comprising:

establishing a flow path for a base fluid;

adding drilling fluid components to the base fluid in the flow path to form a drilling fluid;

analyzing the drilling fluid to determine if it is suitable for passage downhole;

passing the suitable drilling fluid downhole;

returning the suitable drilling fluid from downhole;

separating solids from the returned fluid;

passing the separated fluid to the flow path where it subjected to the steps of analyzing and passing; and recovering any hydrocarbon-base fluids from the separated solids.

14. The method of claim 13 further comprising mixing the non-suitable drilling fluid with the fluid in the flow path before the step of adding.

15. The method of claim 13 wherein the step of separating comprises passing the returned fluid through a shale shaker, a degasser, and a mud cleaner.

16. The method of claim 13 wherein the fluid is seawater and further comprising passing the separated fluid to the sea.

* * * * *